United States Patent [19]

Fingerle et al.

[11] Patent Number: 4,643,144

[45] Date of Patent: Feb. 17, 1987

[54] OPERATING ELEMENT FOR OPERATING THE VALVES OF AN INTERNAL COMBUSTION ENGINE

[75] Inventors: Dieter Fingerle, Hochdorf; Gernot Habel, Plochingen, both of Fed. Rep. of Germany

[73] Assignee: Feldmuele Aktiengesellschaft, Düsseldorf, Fed. Rep. of Germany

[21] Appl. No.: 762,617

[22] Filed: Aug. 5, 1985

[30] Foreign Application Priority Data

Aug. 8, 1984 [DE] Fed. Rep. of Germany ..... 3429169

[51] Int. Cl.[4] ..... F01L 3/02

[52] U.S. Cl. ..... 123/90.39; 123/90.49; 123/90.51; 123/90.6; 123/188 AA

[58] Field of Search ..... 123/90.39, 90.51, 90.6, 123/90.1, 188 AA, 90.49; 29/156.7 R, 156.7 A, 156.7 B

[56] References Cited

U.S. PATENT DOCUMENTS

| | | | |
|---|---|---|---|
| 3,690,958 | 9/1972 | Thompson | 123/90.39 |
| 4,485,770 | 12/1984 | Saka et al. | 123/90.39 |
| 4,538,562 | 9/1985 | Matsui et al. | 23/90.51 |

FOREIGN PATENT DOCUMENTS

| | | | |
|---|---|---|---|
| 8308 | 1/1982 | Japan | 123/90.39 |
| 15705 | 1/1983 | Japan | 123/90.48 |
| 39909 | 3/1984 | Japan | 123/90.39 |
| 162310 | 9/1984 | Japan | 123/90.39 |

*Primary Examiner*—Ira S. Lazarus

*Attorney, Agent, or Firm*—Felfe & Lynch

[57] ABSTRACT

An operating element for the operation of the valves of an internal combustion engine consists of metal and has on its working surface engaged with the cam of a camshaft an insert (2) of ceramic material which is fastened on the operating element (1) with an oil- and heat-resistant, vulcanized bonding layer (3) of an elastomer.

10 Claims, 6 Drawing Figures

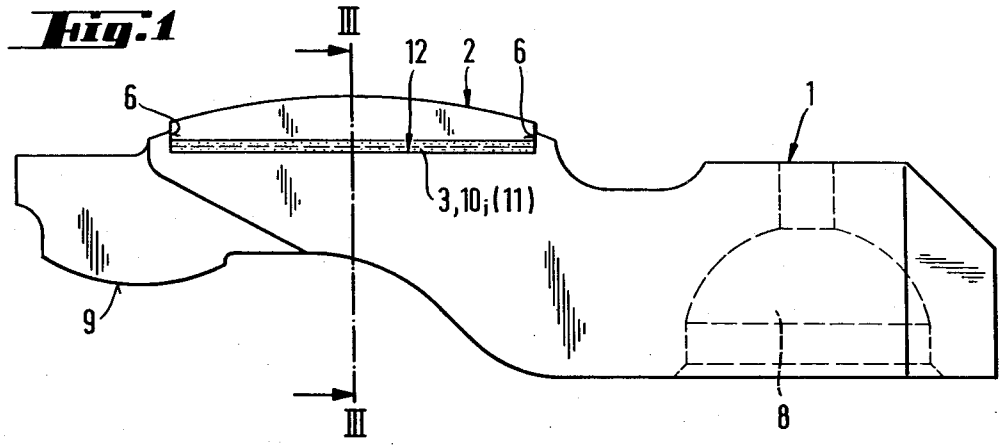
Fig.1
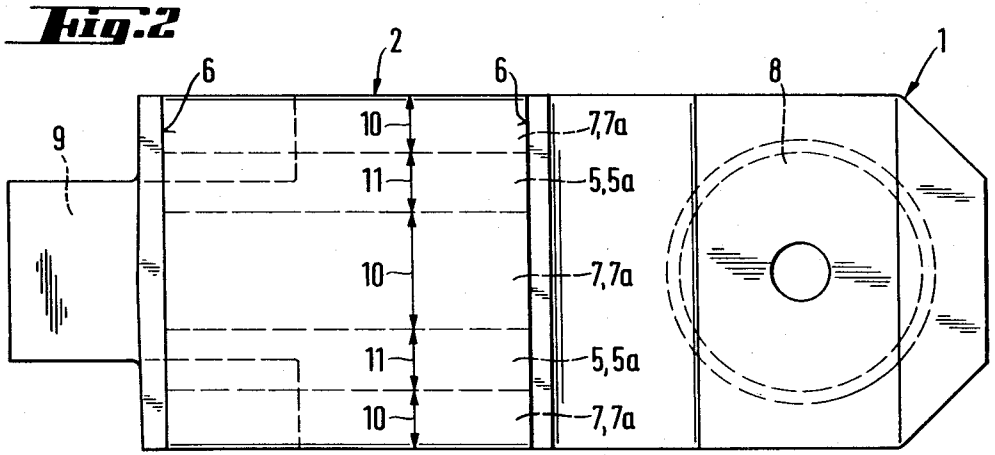
Fig.2
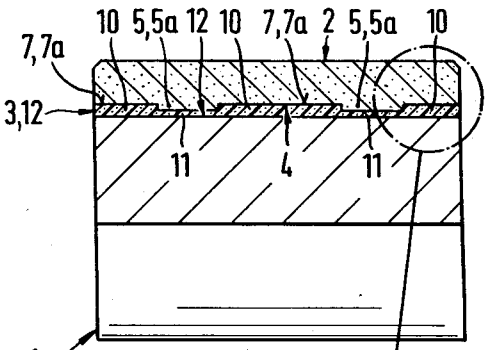
Fig.3
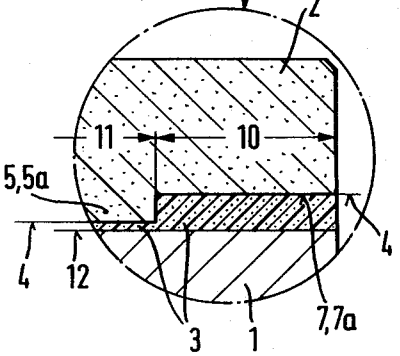

OPERATING ELEMENT FOR OPERATING THE VALVES OF AN INTERNAL COMBUSTION ENGINE

BACKGROUND OF THE INVENTION

The present invention relates to a metal operating element for operating the valves of an internal combustion engine, the element having an insert of ceramic material in its surface in contact with the cams of a camshaft. The term operating element, as used in the description and claims of the present patent application, is to be understood to include valve lifters, rocker arms, pull levers, valve rockers and tappets.

Operating elements of the above-mentioned kind, especially tappets, are disclosed in German Federal publication Nos. DE-A 32 05 878, 32 39 325 and 33 32 455. As methods for fastening the inserts, publication No. DE-A 32 39 325 discloses shrink-fitting, clamping, cementing and casting in aluminum, while publication Nos. DE-A 32 05 878 and No. DE-A 33 32 455 call for cementing with epoxy resin. The proposal has been disclosed in practice that ceramic inserts be fastened to the metal operating elements by brazing. All of these proposals have certain disadvantages, so that in spite of the outstanding properties of the ceramic materials operating elements having an insert of ceramic material have not been widely accepted.

In detail, the disclosed proposals have the following disadvantages:

Cemented bonds which have sufficient and lasting strength in contact with water containing lubricants, even up to temperatures of 150° C., provide insufficient strength under the conditions to which they are exposed in an engine. Epoxy resin bonds which of themselves (not as measured in the working environment) have shear strengths of 20 to 40 Mpa, have proven to be insufficiently reliable. Under the effect of oil and water a strength loss amounting to as much as 50% has been observed.

Brazed joints between ceramic inserts and metal operating elements, which have a still greater shear strength of about 100 MPa can be used only if the coefficients of expansion of the metal and of the ceramic insert are close to one another. If, however, there is a great difference in the coefficients of expansion, tensions are produced both in the ceramic insert and in the brazed junction which lead to cracking and spalling. Another disadvantage of brazed joints lies in the high temperatures of 800° to 900° C. which are necessary for their production. Areas of the metal operating element that have already been heat treated can be degraded thereby. Also disadvantageous are the need to perform the brazing in a vacuum or under shielding gas, the high energy consumption necessitated by the high temperatures, and the high cost of the silver-containing brazing materials.

The embedding of ceramic inserts by casting in metal is possible only if the operating element is made of aluminum, because as a result of the high casting temperatures required with other metals and the resultant thermal shock applied to the ceramic inserts there is a danger of cracking them. Since, however, operating elements of cast iron or steel are necessary for reasons of strength, this mounting technique cannot be practiced in many areas of engine construction. For it has been found that inserts cast in aluminum are not held sufficiently tightly under high stress. The same disadvantages have also been observed in the case of ceramic inserts which were fastened only by shrink fitting or by clamping in the metal operating elements.

Setting out from the disadvantages of the known operating elements, it is the object of the present invention, in an operating element of the above-described kind, to improve the strength of the bond to the ceramic insert such that sufficient strength will be assured even under great and long-lasting stress. Furthermore, the invention is intended to increase the possible combinations of metal and ceramic components, and to create the economic conditions essential to series production by devising a very simple and troublefree method of producing them.

THE INVENTION

To achieve this object, the invention provides the distinctive features of claim 1 in an operating element of the kind described in the beginning.

In accordance with the invention, an excellent bond strength between the ceramic insert and the metal operating element is achieved under the conditions of operation of an internal combustion engine. Metal operating elements in the meaning of the present invention are those made of cast iron, steel, or aluminum or of conventional alloys.

The extraordinarily good adhesion of the ceramic insert to the metal operating element is explained in part by the high resistance of the vulcanized elastomer to oil or oil and water mixtures, but it was surprising to find, when the shear forces necessary for the removal of the ceramic insert were measured at 2–4 MPa, that they were much lower than in the case of epoxy resin bonds. Even though it is still not absolutely certain how the outstanding suitability of the operating element according to the invention is achieved under the conditions prevailing in an engine, it can probably be explained as follows:

Due to the low modulus of elasticity of the vulcanized elastomeric bond layer, tensions produced by the action of the cam are dissipated thus combatting the mechanical destruction of the bond layer.

Other advantages of the invention are that the resilient deformation of the elastomeric bonding layer a certain reduction of noise is achieved. Due to the fact that, in elastomers, a certain compensation of expansion takes place at elevated temperature or under severe mechanical stress, it is possible to combine ceramic materials, such as silicon carbide, for example, with the metal operating element, even though up until now they have not been usable as ceramic inserts on account of the difference between their thermal coefficient of expansion and that of the metal operating element. The simple and straightforward configuration of the operating element according to the invention opens up a broad range of different embodiments and the designer is no longer restricted to the very limited number of possible methods of fastening the inserts which been known heretofore.

In one embodiment suitable for the achievement of sufficient bond strength, the insert is fastened to the operating element by a bonding layer consisting of separate areas. For the achievement of an especially good bond, and for technical production reasons, however, a continuous bonding layer is preferred. What has proven to be especially suitable is a continuous bond layer in which areas of greater thickness of geometrically regular configuration are disposed beside areas of lesser thickness. The areas of greater thickness range from 0.2 to 1 mm, and preferably they have a thickness of 0.4 to 0.8 mm. By areas of this thickness an outstanding bond strength is attained on the one hand and, on the other hand, excessively great elastic deformation is prevented. The areas of lesser thickness are from 0.01 to 0.05 mm thick.

In a preferred embodiment of the present invention, the bond layer comprises an elastomer containing fluorine; fluorosilicon rubber, copolymers of vinylidene fluoride and chlorotrifluoroethylene are preferred. Elastomers on a basis of vinylidene fluoride and hexafluoropropylene have proven to be very particularly desirable. Mixtures of the above-named components are also very suitable. The above-named elastomers provide an especially good bond between the operating element and the ceramic insert at high temperatures and under the action of the common motor oils and lubricants.

In another suitable embodiment, the intermediate layer comprises nitrile rubber, polyacrylate rubber or epichlorhydrin rubber. These types of rubbers and polymers are less expensive and have proven adequate for a number of applications. Elastomers on a basis of butadiene styrene and natural rubber have proven unsuitable on account of their poor resistance to oils.

An especially good and secure bonding of the insert to the operating element is achieved when the insert, in accordance with an especially preferred embodiment, has geometrically shaped elevations and depressions on its bottom side intended for joining to the operating element. In such an embodiment an uninterrupted bonding layer is used whose areas of greater thickness are in the depressions and whose areas of lesser thickness are on the elevations on the bottom of the insert.

An alternative possibility is to provide the operating element with elevations and depressions of regular geometrical configuration on the area to which the bonding layer is to be applied. In this case the insert will have a planar bottom. The formation of elevations and depressions, preferably in the form of tongues and grooves, has proven to be particularly effective because this achieves a very direct introduction of the applied forces into the metal part of the operating element. It has been found to be especially desirable to provide the tongues and grooves on the bottom of the insert or on the operating element such that they run lengthwise of the line of the load, i.e., parallel to the direction of rotation of the cams. This constructional measure is preferred because it has been found that tongues and grooves disposed at right angles to the cams have a shorter useful life on account of the high bending stress applied in this case to the ceramic inserts.

The ceramic materials that can be used in accordance with the present invention for the intended application can be known, partially stabilized zirconium oxide or also mixtures containing aluminum oxide and zirconium oxide, such as those described in German Federal Pat. No. 27 44 700, and also silicon carbide, silicon nitride or silicon oxynitride. If desired, these ceramic materials can also contain other known additives, such as magnesium oxide, yttrium oxide, titanium carbide and titanium nitride. The present invention also permits combining materials which formerly could not be used for the described application on account of differences in thermal coefficients of expansion.

To achieve an especially secure seating of the insert on the operating element it has been found desirable to provide abutments on the operating element in the direction of rotation of the camshaft, for the purpose of additionally fixing the insert in place.

The application of the elastomeric bonding layer, its vulcanization and the joining together of the individual components are performed in a known manner under the action of heat and pressure, and there is no need to fear impairment of heat-treated areas of the operating element as in the case of the brazing process referred to above. Thus economical production is assured.

The following drawings and their description will serve for the further description of the invention.

SUMMARY DESCRIPTION OF THE DRAWINGS

FIG. 1 shows a side view of the operating element of the invention, represented on a rocker arm, FIG. 2 is a top view of the operating element shown in FIG. 1, FIG. 3 is a cross-sectional view taken along the line III—III of FIG. 1.

DESCRIPTION OF PREFERRED EMBODIMENTS

Figure 4:
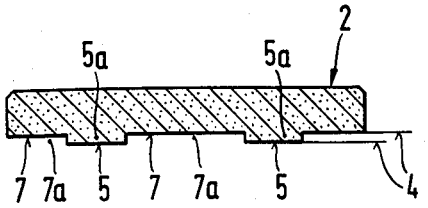
FIG. 4 shows the insert shown in FIG. 3 removed from the operating element.

FIG. 1 shows an operating element 1 in accordance with the invention in the form of a cast steel rocker arm for an overhead camshaft engine. A ceramic insert 2 made of zirconium oxide stabilized with magnesium oxide is held in place by abutments 6 and forms the working surface for a cam. The operating element 1 has a pivot point 8 for the accommodation of a ball-end bolt which is not shown. A hardened lobe 9 serves for the operation of a valve stem which is not shown.

FIG. 2 is a top view of the operating element 1 of FIG. 1 with the insert 2 held in place by abutments 6. Broken lines indicate the orientation of grooves 7*a* and tongues 5*a* in the direction of rotation of the cam.

FIG. 3 is a cross section taken along line III—III of FIG. 1 and shows the operating element 1 with the ceramic insert 2, which is joined by an elastomeric bonding layer 3 consisting of uninterrupted areas in the form of regular strips at the junction 12 with the operating element. The elastomeric layer 3 has areas 10 of greater thickness, of 0.5 mm thickness, which are placed in grooves 7*a* disposed on the bottom 4 of the insert 2, while on the tongues 5*a* the elastomeric bonding layer 3 has a thickness of 0.05 mm in its areas 11 of lesser thickness. The elastomeric bonding layer 3 consists of a copolymer on a basis of vinylidene fluoride and hexafluoropropylene (FKM), which has been vulcanized under heat and pressure to join the insert 2 to the bonding area 12 of the operating element 1. A shear strength of 3 MPa was measured.

FIG. 4 shows elevations 5 in the form of tongues 5*a* and depressions 7 in the form of grooves 7*a* on the bottom of the operating element 2.

Figure 5:
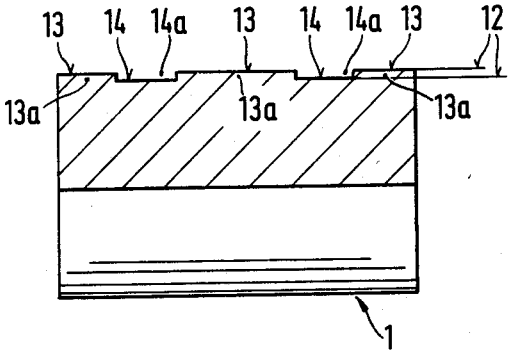
FIG. 5 is a cross-sectional view of an operating element without insert.

In FIG. 5 there is represented an embodiment of the operating element 1 of the invention, wherein the ceramic insert 2 has not yet been installed. In this embodiment, elevations 13 in the form of tongues 13*a* and recesses 14 in the form of grooves 14*a* are provided on the top side of the operating element 1 to form the junction 12.

Figure 6:
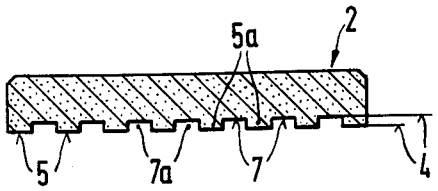
FIG. 6 is an additional embodiment of the insert represented in cross section.

Another embodiment of the ceramic insert 2 is shown in FIG. 6. The difference between this embodiment and the one shown in FIG. 3 is that it has a great number of tongues 5*a* and grooves 7*a* on the bottom of insert 2.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. Operating element of metal for operating the valves of an internal combustion engine, which has on its working surface engaged with the cams of a camshaft an insert of ceramic material, characterized in that the insert (2) of ceramic material is fastened on the operating element (1) by means of a bonding layer (3) comprising an uninterrupted area or separated areas of an oil- and heat-resistant, vulcanized elastomer.

2. Operating element of claim 1, characterized in that the bonding layer (3) comprises areas of regular geometric configuration and of greater (10) and lesser (11) thickness.

3. Operating element of claim 1, characterized in that the areas of greater thickness (12) have a thickness of 0.2 to 1 mm, preferably 0.4 to 0.8 mm, and the areas of lesser thickness (11) have a thickness of 0.01 to 0.05 mm.

4. Operating element of claim 1, characterized in that the bonding layer (3) comprises an elastomer containing fluorine.

5. Operating element of claim 1, characterized in that the bonding layer (3) comprises an elastomer on the basis of a vinylidene fluoride copolymer, a chlorotrifluoroethylene copolymer, a fluorosilicon rubber, preferably of a copolymer on the basis of vinylidene fluoride and hexafluoropropylene, or a mixture of these components.

6. Operating element of claim 1, characterized in that the bonding layer (3) consists of nitrile rubber, polyacrylate rubber or epichlorhydrin rubber.

7. Operating element of claim 1, characterized in that the insert (2) has on its bottom (4) intended for bonding to the operating element, elevations (5) and depressions (7) of regular geometrical configuration.

8. Operating element of claim 1, characterized in that the operating element (1) has a bonding area (12) having elevations (13) and depressions (14) of regular geometrical configuration provided for the application of the bonding layer (3).

9. Operating element of claim 1, characterized in that the recesses (7, 14) are in the form of grooves (7*a*, 14*a*) and the elevations (5, 13) in the form of tongues (5*a*, 13*a*).

10. Operating element of claim 1, characterized in that the ceramic material of the insert (2) is partially stabilized zirconium oxide, a mixture containing aluminum oxide and zirconium oxide, silicon nitride, silicon oxynitride, or a mixture of the above substances.

* * * * *